United States Patent [19]

Engström

[11] Patent Number: 4,676,831

[45] Date of Patent: Jun. 30, 1987

[54] POWDER MIXTURE CONTAINING TALLOIL FREE OF SEGREGATION

[75] Inventor: Ulf F. Engström, Höganäs, Sweden

[73] Assignee: Höganäs AB, Höganäs, Sweden

[21] Appl. No.: 732,045

[22] PCT Filed: Sep. 5, 1984

[86] PCT No.: PCT/SE84/00290

§ 371 Date: Apr. 26, 1985

§ 102(e) Date: Apr. 26, 1985

[87] PCT Pub. No.: WO85/01230

PCT Pub. Date: Mar. 28, 1985

[30] Foreign Application Priority Data

Sep. 9, 1983 [SE] Sweden ..... 8304832

[51] Int. Cl.[4] ..... B22F 1/00; C22C 33/02

[52] U.S. Cl. ..... 75/252

[58] Field of Search ..... 75/251-255; 78/0.5 R

[56] References Cited

U.S. PATENT DOCUMENTS

| | | | |
|---|---|---|---|
| 2,514,312 | 7/1950 | Christ . | |
| 3,583,864 | 5/1969 | Adler | 75/0.5 BA |
| 4,090,868 | 5/1978 | Tengzelius et al. | 75/0.5 R |
| 4,093,449 | 6/1978 | Svensson et al. | 75/0.5 R |

FOREIGN PATENT DOCUMENTS

| | | |
|---|---|---|
| 0029389 | 5/1981 | European Pat. Off. . |
| 3132277 | 6/1982 | Fed. Rep. of Germany . |
| 353740 | 2/1973 | Sweden . |
| 427434 | 4/1983 | Sweden . |
| 2071159 | 9/1981 | United Kingdom . |

OTHER PUBLICATIONS

Mischungs- und Entmischungsprobleme bei Metallpulvern; Teil I: Verhalten von Metallpulvern beim Mischprozeβ-Makroverteilung der Komponenten; Christa Sauer (Dresden); Jun. 6, 1972, pp. 358-362.

Mischungs- und Entmischungsprobleme bei Metallpulvern; Teil II: Verhalten von Metallpulvern beim Mischprozeβ-Mikroverteilung der Komponenten; Christa Sauer (Dresden); Apr. 4, 1973, pp. 231-234.

Mischungs- und Entmischungsprobleme bei Metallpulvern; Teil III: Verhalten des Mischguts beim Transport; Christa Sauer (Dresden); Oct. 10, 1973, pp. 595-598.

*Primary Examiner*—Christopher W. Brody

*Attorney, Agent, or Firm*—Burns, Doane, Swecker & Mathis

[57] ABSTRACT

The present invention refers to iron based powder mixtures, which except iron or steel powder and one or more alloying elements in powder form also contain an addition of up to 0.5% of talloil to prevent segregation/dusting.

8 Claims, 3 Drawing Figures

POWDER MIXTURE CONTAINING TALLOIL FREE OF SEGREGATION

TECHNICAL FIELD

The present invention relates to iron based powder mixes with low risk of segregation and/or dusting. According to this invention it is now possible to produce mechanical mixes of iron or steel powders and alloying powders with low risk of segregation and dusting without deteriorating the characteristic physical properties of the mixture.

In powder metallurgical manufacturing of various types of components iron or steel powders are often used together with one or more alloying elements such as copper or nickel in order to reach mechanical properties which cannot be obtained when using plain iron or steel powders.

Nowadays powders for these purposes are in general prepared in two ways, viz. either as powder mixtures or as fully prealloyed powders. Powder mixtures are prepared by mixing the iron or steel powder with powder containing the desired alloying element or elements, either in the elementary form or as master alloys. The fully prealloyed steel powders are manufactured e.g. by atomizing a steel melt containing the desired alloying elements to a powder.

One of the drawbacks of powder mixtures is related to the fact that such powders consist of particles which often differ considerably in size, shape and density, and which are not mechanically interconnected. This means that such a powder mixture is susceptible to segregation during its transport and handling. This segregation leads to varying composition of the green compacts manufactured from the powder, and thus to varying dimensional changes during the sintering operation and to varying mechanical properties in the as-sintered product.

Another drawback of powder mixtures is their tendency to dust especially if the alloying element is present in the form of very small particles. This can lead to difficult environmental problems when the powder mixture is handled.

In the case of fully prealloyed powders there is no risk of segregation as every powder particle has the same composition. also the risk of dusting is reduced as no alloying powder having small particle size is included. However, the prealloyed powder has another great drawback, viz. its low compressibility which is a result of the solid solution hardening effect which the alloying elements have on each powder particle. High compressibility is essential when high density is a prerequisite for reaching high mechanical properties.

The compressibility of a powder mixture is on the other hand substantially the same as the compressibility of the iron powder included therein. This fact together with the flexibility as regards the alloying composition have made powder mixtures the most commonly used raw material in the production of low alloy sintered steels. In such powder mixtures the plain iron powder is used as a base powder.

BACKGROUND ART

The Swedish patent application No. 7612217-5 describes a method to produce an iron powder containing copper, which has a low risk of segregation and dusting at the same time as the powder properties are maintained. According to this method the powder is produced by an annealing treatment of a mixture of iron and copper powder, at which a so-called partially diffusion alloy between iron and copper is obtained.

As certain alloying elements, such as e.g. phosphorus in the form of a ferrophosphorus powder and carbon in the form of graphite powder, cannot be sufficiently diffusion alloyed with an iron or steel powder without deteriorating the compressibility, there is a risk that mixtures in which these alloying elements are used are prone to segregation and/or dusting.

The Swedish patent application No. 8001764-3 describes a method to prevent segregation and/or dusting by adding to a powder mixture up to 1% of a sticky binder, which does not change its sticky properties with time at normal temperatures. However, it has been found that when binding agents of this nature are added to a dry powder mix the amount, which can be added, is controlled by the characteristic flowability of the powder mix. The amount which can be used with regard to the flow results in a decreased bonding effect between the iron particles and the particles of the alloying elements, why an optimal powder mix from segregation/dusting point of view cannot be obtained.

DISCLOSURE OF INVENTION

The aim of the present invention is therefore to provide powder mixtures on iron powder base, in which the risk of segregation and dusting is very low at the same time as the physical powder characteristics are maintained.

According to the invention this aim is fulfilled by adding during the mechanical mixing operation a binding agent by means of which the alloying particles are attached to the iron or steel powder particles.

According to the invention it is proposed to use a binding agent with good wetting properties in liquid state, which after the admixing is transformed into solid state when exposed to the oxygen in the air. By using such a binder a dry powder mix with good flow properties can be obtained.

Furthermore, the binding agent should have such properties that is can be burned off without any problems at a suitable temperature, e.g. during the sintering of the components made of the powder mixture.

As the binder should be active in the powder mixture until after the compaction it is not allowed to affect the characteristic physical powder properties of the mixture such as apparent density, flow, compressibility and green strength.

To fulfil the above mentioned demands it is preferred to add up to 0.5%, preferably 0.10–0.30%, of the binding agent. Here and in the following "%" is referred to as percent by weight.

According to the invention the binding agent that is preferred is talloil.

According to the invention an iron based powder is mixed with one or more alloying elements, such as graphite of phosphorus, in powder form together with a lubricant for some minutes in order to obtain some homogenization of the mixture. A total content of up to 0.5%, preferably 0.10–0.30%, of the binder is then added and the mixing operation is carried out for a period of time sufficient to obtain a homogeneous mixture. If desired, a lubricant might be added during the mixing operation to facilitate the pressing of the powder in a tool at the final use.

EXAMPLES

In the following the invention is exemplified and in connection therewith the experiments which have been made with powder according to the invention are described together with the surprising results which the experiments have given.

EXAMPLE 1

Figure 1:
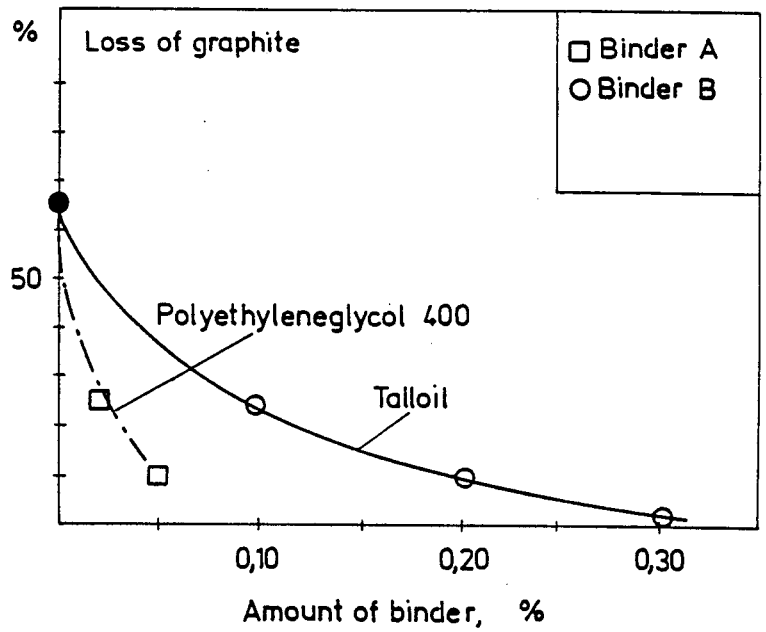
FIG. 1 is a graph depicting the relationship between bonding effect and amount of binder.
Figure 2:
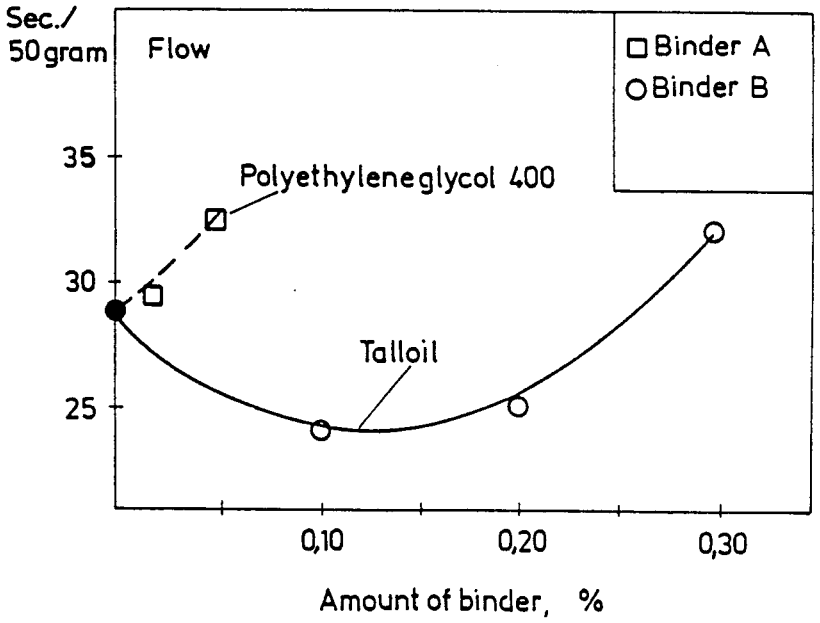
FIG. 2 is a graph depicting the relationship between flowability and amount of binder.

A number of powder mixtures consisting of 98.2% sponge iron powder with a maximum particle size of 175 μm, 1.0% graphite powder with a mean particle size of about 5.0 μm, 0.8% of zincstearate and different additions of polyethyleneglycol 400 and talloil up to 0.5% respectively were prepared. The mixtures were analyzed with regard to both the bonding effect between the iron particles and the alloying particles and the flowability of the powder. The bonding effect was determined by blowing a certain amount of air through the powder mixture and then determine the loss of graphite. The results obtained are shown in FIG. 1 (bonding effect) and FIG. 2 (flowability of the powder).

From the results it can be seen that when talloil is used as a binder a more or less segregation-free powder mixture of iron powder and graphite powder with maintained or improved flow properties can be manufactured. The amount added should be in the range of 0.10–0.30% when iron powder with a particle size mainly below 175 μm is used.

When polyethyleneglycol 400 is added to such type of iron powder the amount, which can be permitted to maintain the characteristic flowability of the powder mixture, is not big enough to result in a completely satisfying binding effect from segregation point of view.

When working with powder mixtures, whose particle size is mainly below 175 μm, it is therefore not satisfying to use this type of binder. However, a binder according to the present invention makes it possible to use iron-graphite-mixtures, which are free of segregation.

EXAMPLE 2

Two powder mixtures 1 and 2 with a composition as shown in the table below were prepared:

| | | |
|---|---|---|
| Mix 1: | 98.8% | iron powder with a particle size mainly below 147 μm, |
| | 1.2% | graphite with a particle size below 45 μm. |
| Mix 2: | 98.8% | iron powder with a particle size mainly below 147 μm, |
| | 1.2% | graphite with a particle size below 45 μm, |

-continued

| | |
|---|---|
| | 0.1% talloil |

To both mixes 0.8% zincstearate was admixed as lubricant.

A fullscale production test was carried out at a manufacturer of sintered components, where 10,000 parts of each mix 1 and 2 were compacted and sintered under normal conditions. The component in question was included in the normal production run of the manufacturer who normally manufactured it from material according to mixture 1. The compacts of the two mixes were sintered at the same time at 1115° C. in a mesh belt furnace in endothermic atmosphere.

Figure 3:
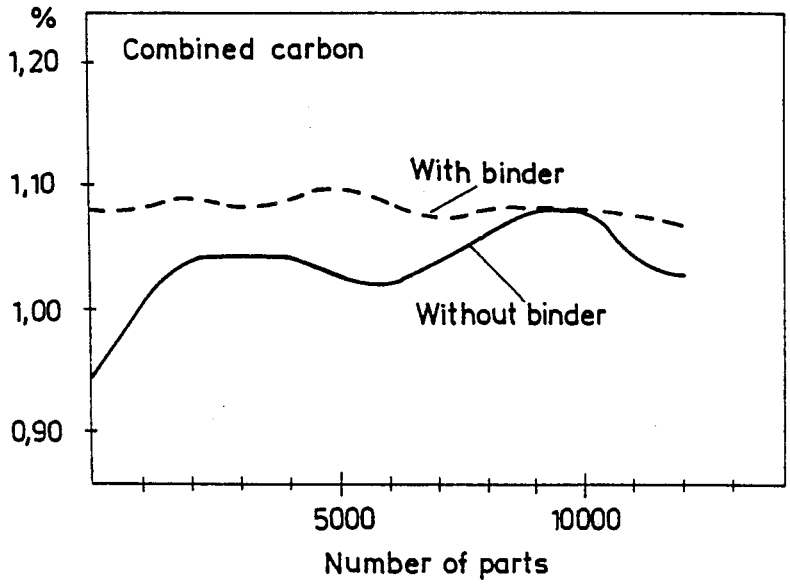
FIG. 3 is a graph depicting the effect of binder on the combined carbon of a statistical number of samples with and without binder.

After sintering a sufficient number of components from a statistical point of view was sampled and the carbon contents of these parts were measured. For mixture 1 carbon contents between 0.97% and 1.11% were obtained, while the same numbers for mixture 2 were 1.07% and 1.10%, i.e. the carbon content range for the material corresponding to mix 1 was 0.14% and 0.03% for the material made of mix 2. These results are shown in FIG. 3.

The above results clearly show that the variation in carbon content within a production series is substantially less when the components have been manufactured from mixture 2 than when the components have been manufactured from mixture 1.

I claim:

1. Iron based powder mixture comprising iron or steel powder, one or more alloying elements in powder form, and an amount up to 0.5% of tall oil to prevent segregation and/or dusting.

2. Iron based powder mixture according to claim 1 wherein the powder mixture contains up to 2.0% of graphite powder.

3. Iron based powder mixture according to claim 1 wherein the mixture contains up to 1.5% of phosphorus added in the form of a ferrophosphorus powder with a particle size of maximum 44 μm and a phosphorus content of 14–18%.

4. Iron based powder mixture according to claim 3 wherein the mixture contains up to 2.0% of graphite powder.

5. Iron based powder mixture according to claim 1 wherein said powder mixture contains 0.10–0.30% of tall oil.

6. Iron based powder mixture according to claim 5 wherein the powder mixture contains up to 20% of graphite powder.

7. Iron based powder mixture according to claim 5 wherein the mixture contains up to 1.5% of phosphorus added in the form of a ferrophosphorus powder with a particle size of maximum 44 μm and a phosphorus content of 14–18%.

8. Iron based powder mixture according to claim 7 wherein the mixture contains up to 2.0% of graphite powder.

* * * * *